US005997613A

United States Patent [19]

Kaneko et al.

[11] Patent Number: 5,997,613

[45] Date of Patent: Dec. 7, 1999

[54] GAS PHASE ADSORPTION PROCESS UTILIZING OXIDIZED PITCH-BASED ACTIVATED CARBON FIBERS

[75] Inventors: Katsumi Kaneko, Ichihara; Takeshi Maeda, Kobe, both of Japan

[73] Assignee: Osaka Gas Company Limited, Osaka-fu, Japan

[21] Appl. No.: 07/887,394

[22] Filed: May 21, 1992

Related U.S. Application Data

[63] Continuation of application No. 07/668,697, Mar. 7, 1991, abandoned, which is a continuation of application No. 07/423,247, Oct. 18, 1989, abandoned.

[30] Foreign Application Priority Data

Oct. 25, 1988 [JP] Japan ..... 63/268877

[51] Int. Cl.[6] ..... B01D 53/42

[52] U.S. Cl. ..... 95/126; 95/117; 95/121; 95/123; 95/128

[58] Field of Search ..... 55/35, 70; 502/38, 502/56; 95/128, 141, 117, 121, 123, 126

[56] References Cited

U.S. PATENT DOCUMENTS

| | | | |
|---|---|---|---|
| 3,720,536 | 3/1973 | Scola et al. | 423/460 |
| 3,723,607 | 3/1973 | Kalnin | 423/447.7 |
| 3,745,104 | 7/1973 | Hou | 423/447.7 |
| 3,816,598 | 6/1974 | Cunningham | 423/447.7 |
| 3,959,448 | 5/1976 | Fuller et al. | 423/447.6 |
| 4,046,525 | 9/1977 | Matsuo et al. | 55/59 |
| 4,073,869 | 2/1978 | Kalnin | 423/460 |
| 4,111,842 | 9/1978 | van Montfoort et al. | 502/184 |
| 4,657,753 | 4/1987 | Bolt et al. | 423/447.6 |
| 4,686,096 | 8/1987 | Schulz et al. | 423/447.6 |
| 4,831,011 | 5/1989 | Oikawa et al. | 502/406 |

FOREIGN PATENT DOCUMENTS

| | | | |
|---|---|---|---|
| 0120139 | 10/1984 | European Pat. Off. . | |
| 366539 | 5/1990 | European Pat. Off. . | |
| 49-116332 | 7/1974 | Japan . | |
| 59-32921 | 2/1984 | Japan . | |
| 61-34225 | 2/1986 | Japan . | |
| 1180441 | 2/1970 | United Kingdom | 423/447.6 |

OTHER PUBLICATIONS

Hawley's Condensed Chemical Dictionary Eleventh Edition; N. Irving Sax and Richard J. Lewis, Sr.; 1987, pp. 218–219.

Patent Abstracts of Japan, vol. 10, No. 185 (C–357) [2241] published on Jun. 27th, 1986.

Carbon, vol. 26, No. 6, 1988, pp. 749–571, authored by I.K. Ismail, et al and published in 1988 in the U.S.

Chemical Abstracts, vol. 103:9198q *Carbon Fibers* No Date no translation.

"JETI..." 1988, vol. 36, No. 10, pp. 118–121; published Oct. 1, 1988.

DiaLog Search Report Dec. 1990.

*Primary Examiner*—Steven Bos
*Assistant Examiner*—Stuart L. Hendrickson
*Attorney, Agent, or Firm*—Larson & Taylor

[57] ABSTRACT

A gas phase adsorption process in which a gas phase containing water vapor or a basic gas is brought into contact with activated carbon fiber to adsorb the water vapor or basic gas. The activated carbon fiber comprises pitch-based oxidized activated carbon fiber having oxygen-containing functional groups and an oxygen content of 3–18% by weight, based on the weight of the fiber. The oxidized activated carbon fiber is prepared by oxidizing pitch-based activated carbon fiber having a specific surface area of 200–2500 $m^2/g$.

15 Claims, 7 Drawing Sheets

GAS PHASE ADSORPTION PROCESS UTILIZING OXIDIZED PITCH-BASED ACTIVATED CARBON FIBERS

This is a continuation of application Ser. No. 07/668,697 filed Mar. 7, 1991, now abandoned, which was a continuation of application Ser. No. 07/423,247, filed Oct. 18, 1989, now abandoned.

The present invention relates to pitch-based activated carbon fibers and a process for preparing the same.

Activated carbon fibers have been heretofore employed as materials useful for gas phase adsorptions as in removal of nitrogen oxides detrimental to humans and contained in the exhaust gases from factories, motor vehicles or the like, in recovery of solvents, etc. and for liquid phase adsorptions as in purification of municipal water or sewage, in disposal of waste water, etc.

In recent years, it is desired to improve the adsorptive capacity of activated carbon fibers. To meet this demand, a method has been proposed for improvement of hygroscopicity by heating cellulose-based activated carbon fibers in air for oxidation as disclosed in Japanese Unexamined Patent Publication (Kokai) No.32,921/1984.

When the surface of activated carbon fibers has been coated with the impurities of exhaust gas or with a product formed on decomposition or polymerization of adsorbed materials, the adsorbed materials can not be removed by conducting a usual thermal desorption method at a temperature of 100 to 200° C. In this case, the adsorbed materials must be removed by heating at a higher temperature or by calcination at a temperature of 750 to 900° C. for reactivation.

The cellulose-based activated carbon fibers as used in said conventional method are burnt away or impaired in properties when heated in air at a temperature exceeding 350° C., making impossible thermal desorption in air. Therefore the heating of cellulose-based activated carbon fibers entails the disadvantages of requiring a regeneration treatment in an atmosphere of inert gas such as combustion gas, carbon dioxide gas, steam or the like and thus necessitating equipment for supplying and retaining the inert gas atmosphere, consequently involving labor for regeneration and increasing the equipment costs.

It is an object of the present invention to provide activated carbon fibers which have an improved adsorptive capacity and which facilitate an effective regeneration treatment irrespective of the degree of adsorption involved.

The present invention provides pitch-based activated carbon fibers which contain oxygen in an amount of at least about 3% by weight based on the whole weight of the pitch-based activated carbon fibers.

The invention also provides a process for preparing the foregoing improved pitch-based activated carbon fibers of the invention, the process comprising oxidizing the pitch-based activated carbon fibers.

The pitch-based activated carbon fibers of the invention have the excellent feature of being capable of adsorbing well ammonia gas and like basic gases, water vapors, etc. due to the high oxygen content.

Moreover, the pitch-based activated carbon fibers of the invention have such high heat resistance that they can be heat-treated even under conditions under which conventional cellulose-based activated carbon fibers would be likely to burn away or deteriorate in properties, namely the conditions of high temperatures in air or like oxygen-containing gas. Consequently the pitch-based activated carbon fibers of the invention can be calcined in air or like oxygen-containing gas for reactivation and such calcination can remove, without use of inert gas, the adsorbed materials unremovable by a usual thermal desorption method as well as those removable thereby. With this advantage, the pitch-based activated carbon fibers of the invention eliminate a need for large-scale equipment for regeneration and enable easy and effective regeneration treatment employing simplified equipment irrespective of the degree of adsorption and the kind of adsorbed materials.

The process of the invention comprises an extremely simple procedure of oxidation and can produce with extreme ease the pitch-based activated carbon fibers of the invention so improved as to exhibit the aforesaid outstanding properties, hence commercially advantageous.

The reason why the improved pitch-based activated carbon fibers of the invention have the high adsorptive capacity remains to be fully clarified. Presumably the reason is as follows.

The improved pitch-based activated carbon fibers of the invention have a surface provided with oxygen-containing functional groups such as carbonyl group, carboxyl group, lactone group or the like due to the high oxygen content, so that the fibers are given an increased affinity for water, ammonia gas or the like and thus an enhanced adsorptive capacity.

The improved pitch-based activated carbon fibers of the invention have the feature of containing oxygen in an amount of at least about 3% by weight, preferably about 3 to about 18% by weight, more preferably about 6 to about 10% by weight, based on the whole weight of the improved pitch-based activated carbon fibers of the invention.

Pitch which is the starting material of common pitch-based activated carbon fibers has an oxygen content of about 1.5% by weight. The pitch-based activated carbon fibers prepared from such pitch in the conventional manner as by spinning the pitch, infusibilizing the thus obtained pitch fibers and activating the thus obtained carbon fibers have an oxygen content of about 1.0 to 1.5% by weight. In contrast the improved pitch-based activated carbon fibers of the invention have an oxygen content of not less than 2 times that of conventional pitch-based activated carbon fibers.

The improved pitch-based activated carbon fibers of the invention can be formed by oxidizing conventional pitch-based activated carbon fibers.

Pitch-based activated carbon fibers useful as the starting material in this invention are not specifically limited and can be any of conventional pitch-based activated carbon fibers prepared in the conventional manner as by first preparing pitch by purification and distillation of coal tar and subsequent polycondensation, melt spinning the pitch, either infusibilizing the resulting fibers or infusibilizing and carbonizing the same to give carbon fibers and activating the carbon fibers.

The melt spinning and infusibilizing steps are not specifically limited and can be conducted by the conventional method as by feeding pitch to a spinning device, forcing out through a nozzle the pitch heated at about 300 to about 400° C. under pressure applied with use of inert gas to form pitch fibers and maintaining the fibers at about 300 to about 400° C. in an oxidizing atmosphere for about 0.3 to about 1.5 hours to infusibilize the fibers. The carbonization of infusibilized fibers can be performed by the conventional method as at about 800 to about 1500° C. in an inert gas atmosphere for about 0.5 to about 30 minutes. The activation of either infusibilized fibers or infusibilized and carbonized fibers can be done in the conventional manner as in the presence of a known activator such as steam, alkali metal hydroxide or the like at a temperature of about 700 to about 1000° C. for about 0.5 to 1 hour. Pitch-based activated carbon fibers useful as the starting material in the invention are disclosed, for example, in Japanese Unexamined Patent Publication (Kokai) No.34225/1986.

Among the pitch-based activated carbon fibers obtained by the foregoing method for use as the starting material in the invention, preferable are those having a fiber diameter of about 12 μm, a tensile strength of about 8 to about 25 $kg/mm^2$, a tension modulus of about 330 to about 700 $kg/mm^2$, a specific surface area of about 200 to about 2500 $m^2/g$ or about 700 to about 2500$m^2/g$, and preferably about 300 to about 1000 $m^2/g$ and a pore radius of about 5 to about 20 Å, preferably about 7 to about 10 Å and particularly about 8 Å.

The pitch-based activated carbon fibers for use as the starting material is oxidized in the invention. The oxidation can be performed by (1) exposing the starting material pitch-based activated carbon fibers to an ozone-containing atmosphere, (2) immersing the pitch-based activated carbon fibers in a hydrogen peroxide solution, (3) immersing the same in nitric acid or (4) heating the same in an oxygen-containing atmosphere.

Each of the methods (1) to (4) is performed such that the obtained pitch-based activated carbon fibers of the invention are given the specific oxygen content. Thus the conditions for each of the methods (1) to (4) are not specifically limited and are variable over a wide range. Yet preferred conditions are as follows.

For bringing the pitch-based activated carbon fibers into contact with the ozone-containing atmosphere, hydrogen peroxide solution or nitric acid in the method (1), (2) or (3), the pitch-based activated carbon fibers are kept in contact with an ozone-containing atmosphere having an ozone concentration of about 700 to about 1000 ppm and containing nitrogen, air and the like at or about room temperature for about 5 to about 20 hours; or with a hydrogen peroxide solution having a concentration of about 20 to about 30% by weight at room temperature for about 0.5 to about 1 hour, during which the temperature of the hydrogen peroxide solution (room temperature at the beginning of immersion) is elevated to the boiling point thereof due to the heat of reaction; or with nitric acid having a concentration of about 30 to about 40% by weight at a boiling point thereof for about 0.5 to about 1 hour. Preferably, the oxidized fibers are washed with water for safety in case of immersion in nitric acid.

The method (4) is carried out by heating the fibers in an oxygen-containing atmosphere. The oxygen-containing atmosphere most preferably is air per se, but may be one similar in oxygen content to air and containing an inert gas such as nitrogen gas, argon gas, helium gas or a mixture thereof. The heating temperature in the method (4) is about 300 to about 900° C., preferably about 400 to about 600° C., more preferably about 450 to about 550° C. The heating in the method (4) continues until the oxygen content of the pitch-based activated carbon fibers reaches the specific level, usually for about 0.25 to about 0.75 hour. The oxidation consumes the pitch-based activated carbon fibers in an amount increased as the heating temperature approaches 900° C. so that the heating time is shorter than, e.g., 0.5 hour at this temperature range. On the other hand, the oxidation consumes the pitch-based activated carbon fibers in an amount decreased as the heating temperature approaches 300° C., so that the heating time is longer at this temerature range. When done at a temperature of about 300 to about 900° C. according to the invention, the heat treatment reduces the weight of fibers at a ratio of about 30% or less. Advantageously the heating in the invention does not decrease but increases the pore volume.

The improved pitch-based activated carbon fibers of the invention thus obtained retain or increase, although slightly, the pore volume of the pitch-based activated carbon fibers used as the starting material. The hygroscopicity of the improved pitch-based activated carbon fibers of the invention is significantly improved, and thus the hygroscopicity as determined, for example, at RH of 30% is 12 times that of the starting pitch-based activated carbon fibers. The improved pitch-based activated carbon fibers of the invention can adsorb basic gases, particularly ammonia, in an amount of about 1.2 to about 8 times larger than the starting pitch-based activated carbon fibers, as determined at a relative ammonia pressure of 50 to 600 Torr.

Further, the improved pitch-based activated carbon fibers of the invention have such excellent heat resistance that they enable regeneration treatment by thermal desorption even in air at a high temperature ranging from about 500 to about 900° C. Accordingly the pitch-based activated carbon fibers of the invention have the further advantage of eliminating a need for large-scale equipment for regeneration. In other words, the invention enables easy and effective regeneration treatment employing simplified equipment irrespective of the degree of adsorption and the kind of adsorbed materials.

The present invention will be described below in greater detail with reference to the accompanying drawings in which.

EXAMPLE 1

Pitch-based activated carbon fibers having a nominal specific surface area of 1,000 $m^2/g$ (tradename "A-10," product of Osaka Gas Co., Ltd.) were heated in air at a temperature of 600° C. for 1 hour, giving improved pitch-based activated carbon fibers of the invention.

The improved pitch-based activated carbon fibers of the invention and untreated pitch-based activated carbon fibers (tradename "A-10," product of Osaka Gas Co., Ltd., Comparison Example 1) for comparison were subjected to elementary analysis and checked for hygroscopicity.

The adsorption amount of moisture for determining the hygroscopicity was measured at RH of 30% and 50% by the method to be described later (see FIG. 10). Tables 1 and 2 below show the results.

TABLE 1

| | Carbon (%) | Hydrogen (%) | Oxygen (%) | Others (%) |
|---|---|---|---|---|
| Example 1 | 92.0 | 0.4 | 6.3 | 1.3 |
| Comparison Example 1 | 97.5 | 0.5 | 1.0 | 1.0 |

TABLE 2

| | Adsorption Amount of Moisture (mg/g) | |
|---|---|---|
| | 30% RH | 50% RH |
| Example 1 | 120 | 280 |
| Comparison Example 1 | 10 | 50 |

The pitch-based activated carbon fibers were given an increased content of oxygen by the oxidation according to the invention (see Table 1). This leads to presumption that oxygen-containing functional groups have been provided on the surface of pitch-based activated carbon fibers by the oxidation. The pitch-based activated carbon fibers of the invention had a hygroscopicity 5.6 to 12 times as high as that of the untreated pitch-based activated carbon fibers (see Table 2).

In view of the above, it is presumed that the surface of pitch-based activated carbon fibers of the invention has been imparted oxygen-containing functional groups by the oxidation, whereby the affinity for water has been increased, resulting in marked rise of hygroscopicity.

The activated carbon fibers of the invention were subjected to the following tests to determine the properties thereof.

Test 1

The pitch-based activated carbon fibers having a nominal specific surface area of 1,000 $m^2/g$ (tradename "A-10," product of Osaka Gas Co., Ltd.) were heated in air for 1 hour at each of varied temperatures. The weights of oxidized and untreated fibers were measured to determine the ratio of the post-treatment weight to the pre-treatment weight, namely the ratio of weight decrease. A graph is shown in FIG. 1 wherein the heating temperature (represented as the temperature for oxidation in air) is plotted as abscissa and the ratio of the post-treatment weight to the pre-treatment weight as ordinate.

Figure 1:
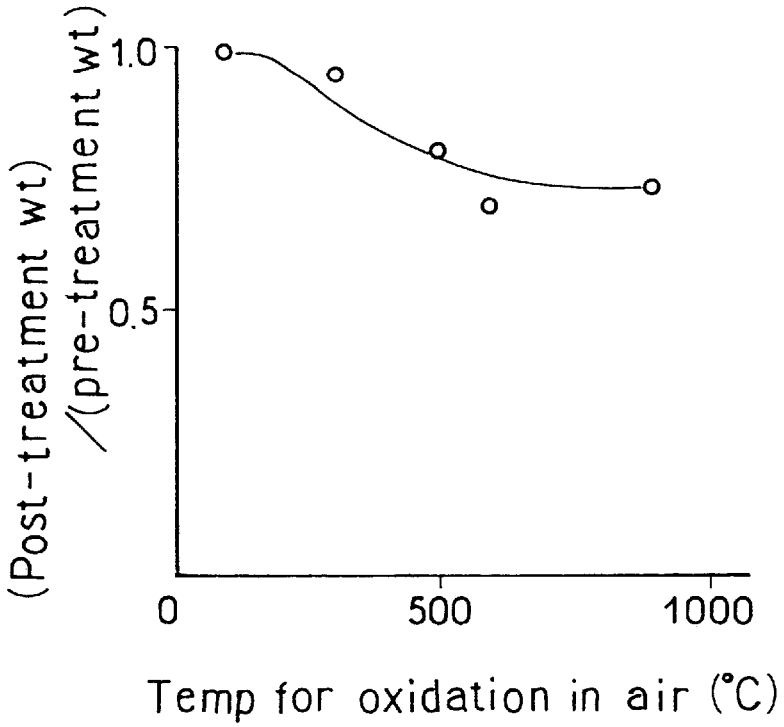
FIG. 1 is a graph showing the relationship between the temperature for oxidation in air and the ratio of post-oxidation weight to pre-oxidation weight of the fibers.

FIG. 1 shows that the pitch-based activated carbon fibers of the invention was 20% in weight decrease when heated in air at 500° C. and 27% in weight decrease when heated in air at 900° C., and that the pitch-based activated carbon fibers of the invention have a high heat resistance and can be regenerated by thermal desorption at a high temperature of 500 to 900° C.

Test 2

Measurement was made of the amount of $N_2$ gas adsorbed at a boiling point of liquid nitrogen by the respective pitch-based activated carbon fibers prepared in Test 1. A graph is shown with a line (○—○) in FIG. 2 wherein the heating temperature (represented as the temperature for oxidation in air) is plotted as abscissa and the adsorption amount of $N_2$ gas as ordinate.

For comparison, cellulose-based activated carbon fibers having a nominal specific surface area of 1,500 $m^2/g$ (tradename "KF 1500", product of Toyobo Co., Ltd.) were heated in air for 1 hour at each of varied temperatures. The amount of $N_2$ gas adsorbed by each of the cellulose-based activated carbon fibers thus prepared was determined and the result was plotted with a line (Δ—Δ) in FIG. 2 in the same manner as above.

The oxidation of the cellulose-based fibers in air at a temperature of just over 400° C. resulted in sharp decrease in the adsorption amount of $N_2$ gas, and the oxidation thereof in air at a temperature of 500° C. led to zero in adsorption amount of $N_2$ gas. This indicates that when heated at above 400° C., the cellulose-based activated carbon fibers burn and deteriorate in properties and that when heated at above 500° C., the cellulose-based activated carbon fibers burn out.

The cellulose-based activated carbon fibers burn out when oxidized at 500° C. and cannot be subjected to oxidation at above 500° C. Contrastedly, the pitch-based activated carbon fibers used as the starting material in the invention can withstand the oxidation at above 500° C., and the thus-obtained improved pitch-based activated carbon fibers are endowed with an enhanced adsorptive capacity for nitrogen gas.

Figure 2:
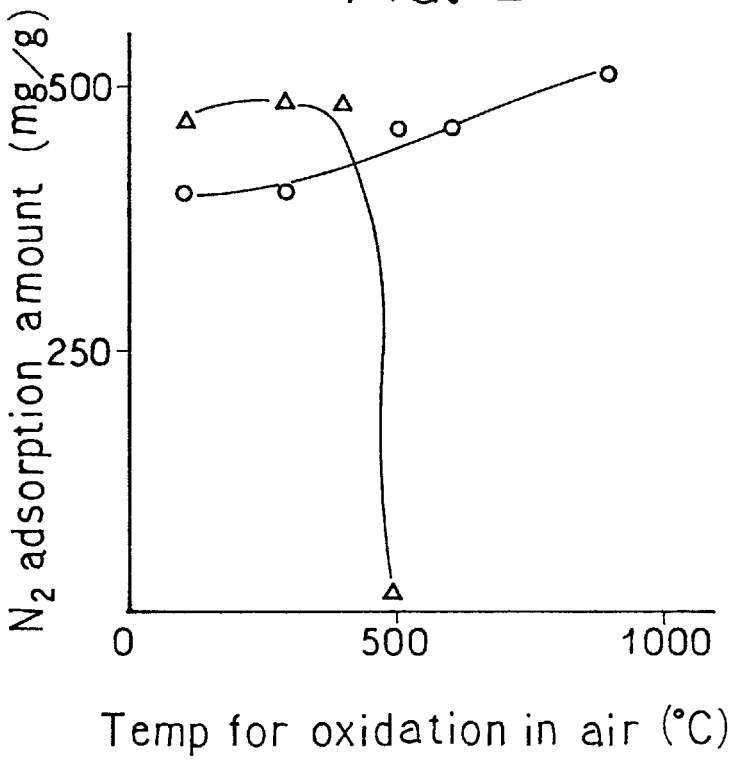
FIG. 2 is a graph showing the relationship between the temperature for oxidation in air and the adsorption amount of $N_2$.

FIG. 2 shows that the cellulose-based activated carbon fibers exhibit a higher adsorptive capacity for nitrogen gas at or below about 350° C. than the pitch-based activated carbon fibers. This is because the cellulose-based activated carbon fibers used herein had a specific surface area of 1,500 $m^2/g$ whereas the pitch-based activated carbon fibers used had a specific surface area of 1,000 $m^2/g$.

Test 3

The pitch-based activated carbon fibers having a nominal specific surface area of 1,000 $m^2/g$ (tradename "A-10", product of Osaka Gas Co., Ltd.) were heated in air at 900° C. which is a maximum calcination temperature for reactivation. Four kinds of improved pitch-based activated carbon fibers were prepared by heating at this temperature for varied periods. The weights of oxidized and untreated fibers were measured to determine the ratio of weight decrease. A graph is shown in FIG. 3 wherein the heating time (indicated as the time for oxidation in air) is plotted as abscissa and the ratio of post-treatment weight to pre-treatment weight as ordinate.

Figure 3:
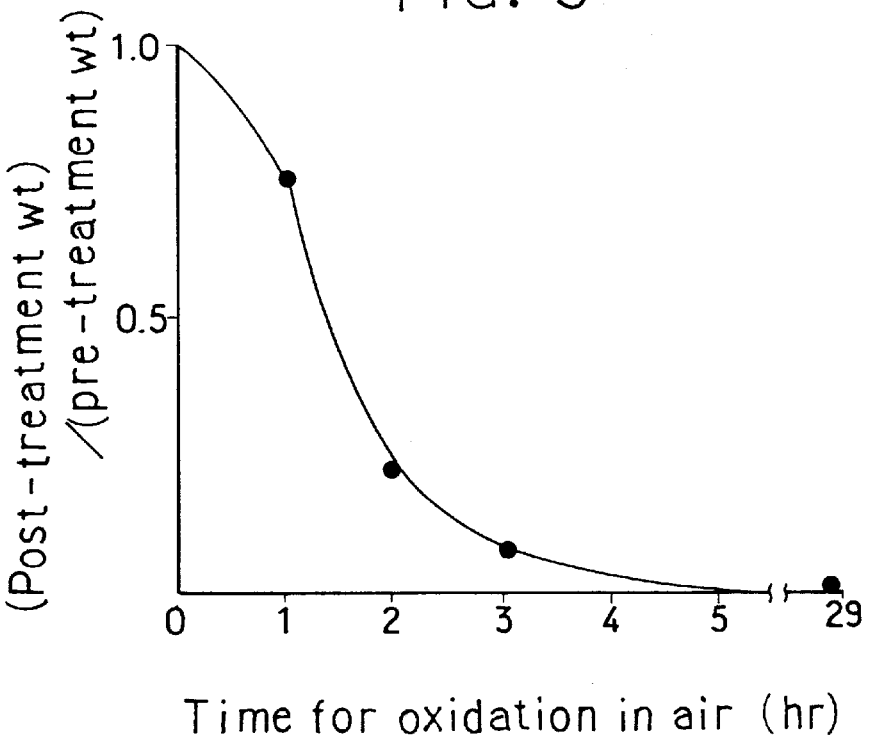
FIG. 3 is a graph showing the relationship between the time taken for oxidation in air and the ratio of weight of oxidized fibers to the weight of the untreated fibers.

FIG. 3 shows the following. While the pitch-based activated carbon fibers are kept unburnt by oxidation at 900° C. for up to about 3 hours, a marked weight decrease results from oxidation at 900° C. for longer than 1 hour. This shows that the heat treatment for oxidation at 900° C. needs to be completed within 1 hour or so. In other words, the pitch-based activated carbon fibers can be subjected to heat treatment at 900° C. for less than about 1 hour. It is therefore evident that the improved pitch-based activated carbon fibers can be regenerated in air by calcination for reactivation under usual calcination conditions for reactivation (750 to 900° C., about 30 to about 60 minutes).

Test 4

The pore volume was determined based on the adsorption amount of $N_2$ measured in the same manner as in Test 2. A graph is shown in FIG. 4 wherein the heating temperature (represented as the temperature for oxidation in air) is plotted as abscissa and the pore volume as ordinate.

Figure 4:
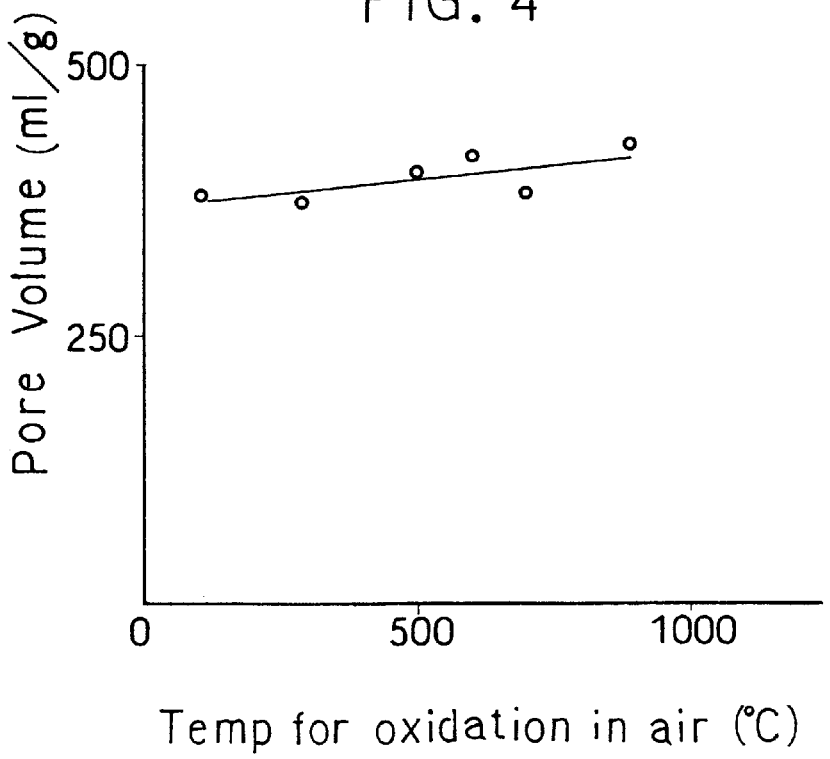
FIG. 4 is a graph showing the relationship between the temperature for oxidation in air and the pore volume.

FIG. 4 shows the following. The heat treatment according to the invention retains the fibers free from reduction of pore volume and collapse of pores. The results demonstrate that the higher the heat-treatment temperature, the larger the pore volume is. It is clear that the pitch-based activated carbon fibers having a large pore volume can be obtained by the heat treatment according to the invention.

Test 5

Figure 5:
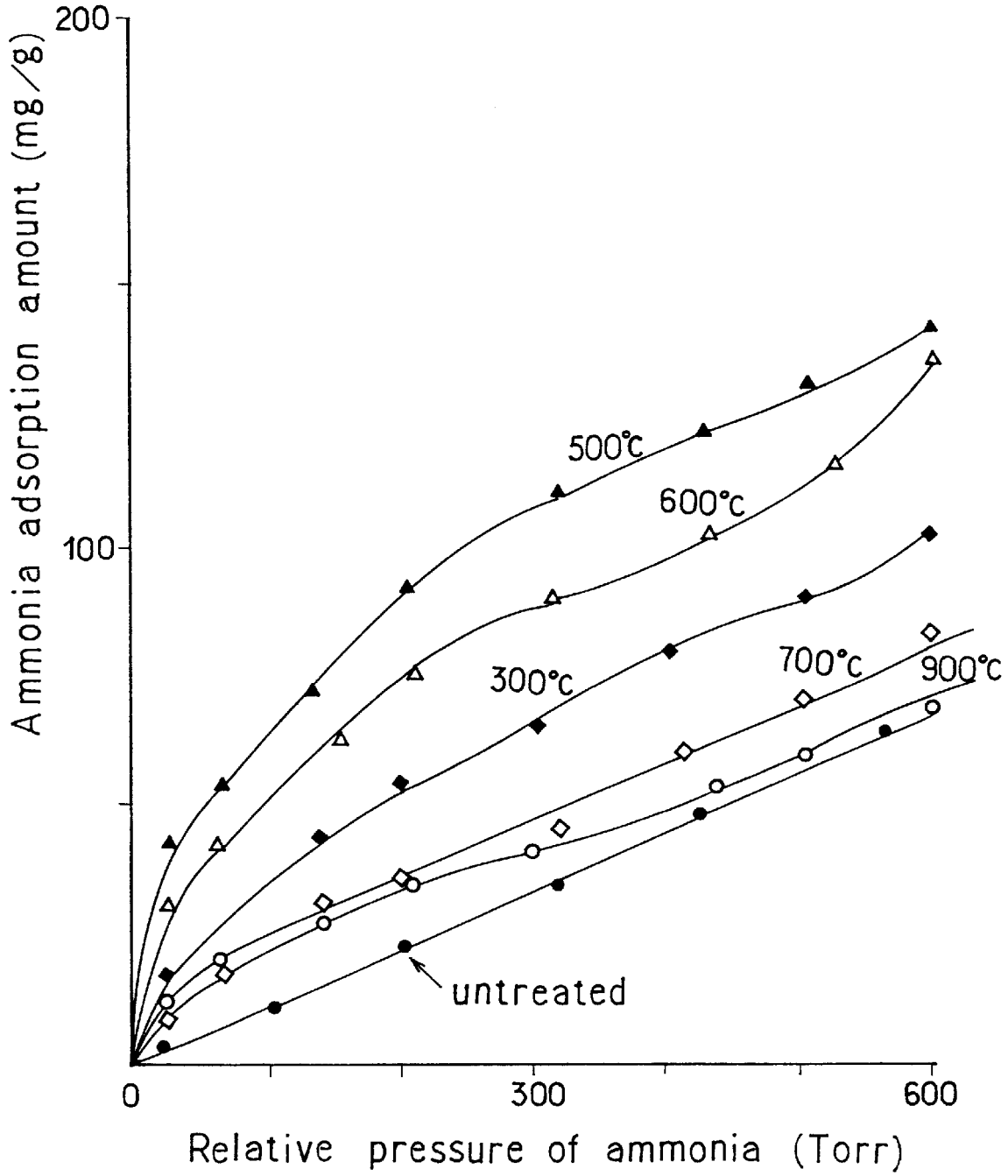
FIG. 5 is a graph showing the relationship between a relative pressure of ammonia and the adsorption amount of ammonia.

The pitch-based activated carbon fibers having a nominal specific surface area of 1,000 $m^2/g$ (tradename "A-10", product of Osaka Gas Co., Ltd.) were heated in air for 1 hour at each of varied temperatures (temperatures for oxidation in air). The adsorption amount of ammonia was determined in respect of thus obtained fibers and untreated fibers. A graph is shown in FIG. 5 wherein the relative pressure of ammonia is plotted as abscissa and the adsorption amount of ammonia as ordinate. The temperature in the graph indicates the temperature used for the above heating.

Figure 6:
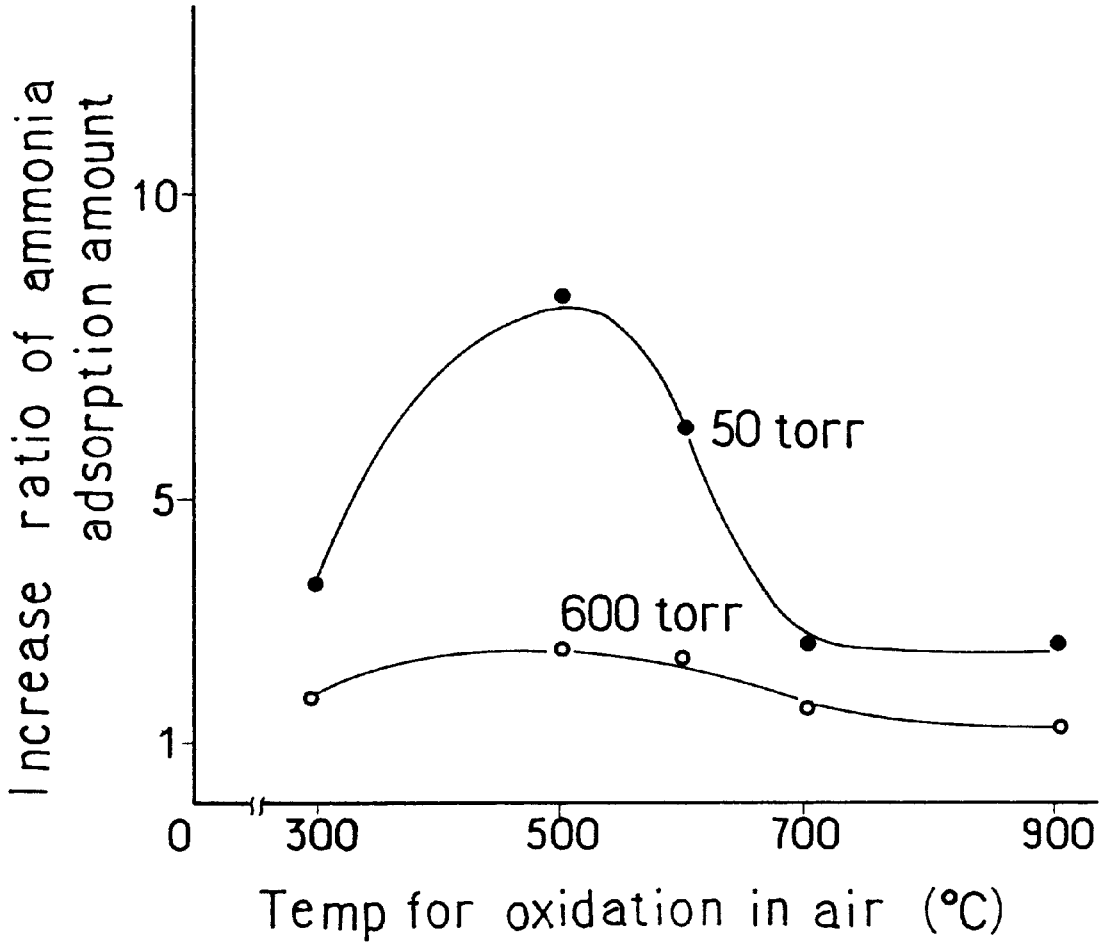
FIG. 6 is a graph showing the relationship between the temperature for oxidation in air and the increase ratio of adsorption amount of ammonia.

The above test results obtained under ammonia relative pressure of 50 Torr and 600 Torr are also shown in FIG. 6 in which the temperature for oxidation in air is plotted as abscissa and the increase ratio of ammonia adsorption amount as ordinate wherein the amount of ammonia adsorbed by untreated pitch-based activated carbon fibers is taken as 1.

Figure 7:
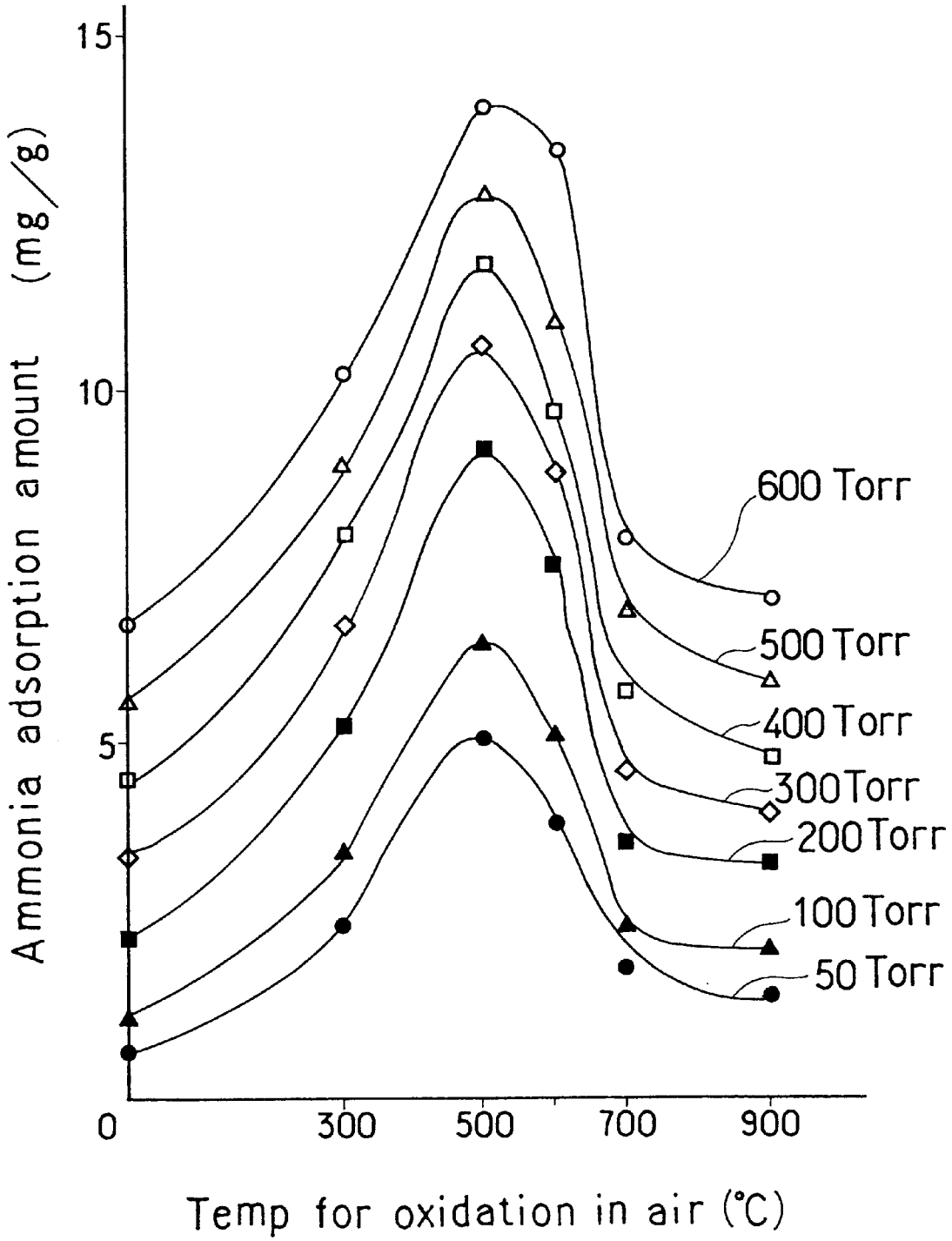
FIG. 7 is a graph showing the relationship between the temperature for oxidation in air and the adsorption amount of ammonia.

Further the above test results are represented with a graph in FIG. 7 with the temperature for oxidation in air plotted as abscissa and the adsorption amount of ammonia as ordinate.

FIGS. 5 to 7 reveal that the improved pitch-based activated carbon fibers of the invention exhibit a higher adsorptive capacity for ammonia than the untreated pitch-based activated carbon fibers (see FIG. 5) and that the pitch-based activated carbon fibers of the invention obtained by oxidation at about 500° C. are imparted a significantly high adsorptive capacity (see FIGS. 6 and 7).

Figure 8:
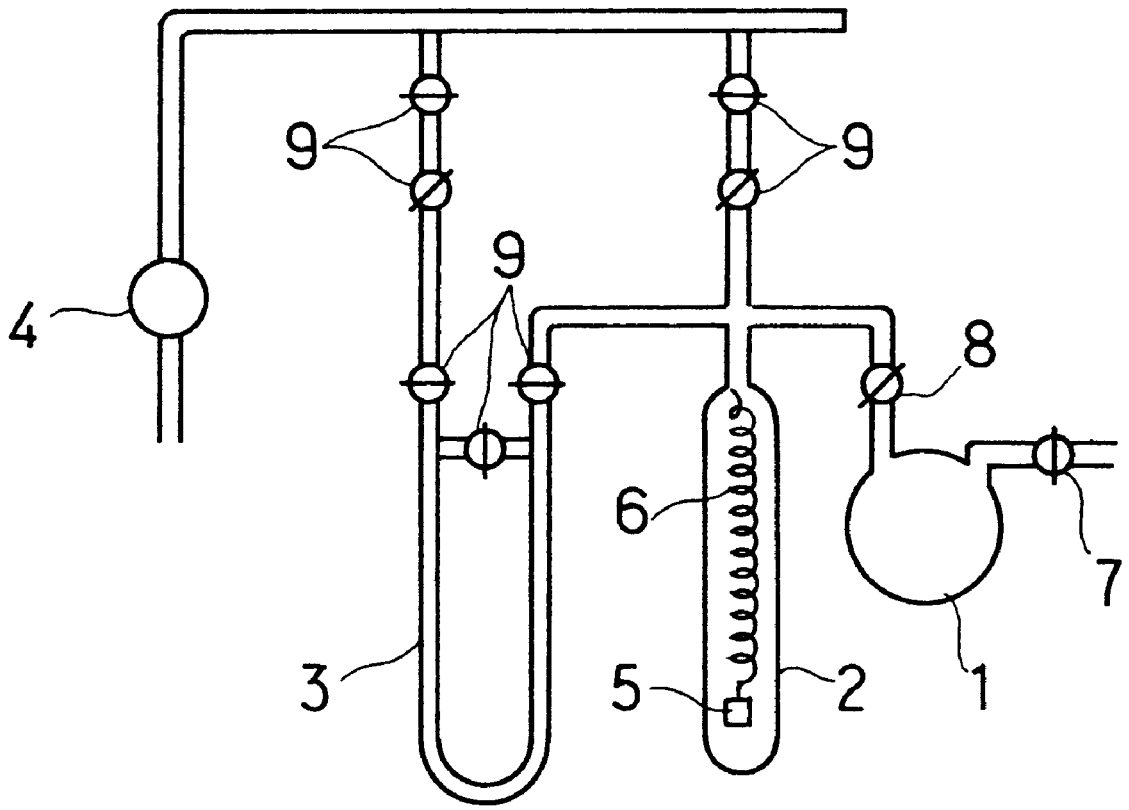
FIG. 8 is a view schematically showing the structure of a device for measuring the adsorption amount of ammonia.

The adsorption amount of ammonia referred to herein was determined by the following method with use of a measuring device having the structure as shown in FIG. 8.

The measuring device comprises a gas reservoir 1, a specimen-holding tube 2, a mercury manometer 3 and a vacuum pump 4, all connected and communicated with each other. First 100 mg of pitch-based activated carbon fibers specimen was placed into a basket 5. The basket 5 was attached to the forward end of a quartz spring 6 (tension modulus of 60 to 120 mm/g) and inserted into the specimen-holding tube 2.

A cock 7 at an inlet toward the gas reservoir 1 was closed while a cock 8 at an outlet and cocks 9 were opened. In this state, a vacuum pump 4 was put into operation to evacuate the gas reservoir 1 by reducing the pressure therein to about $10^{-4}$ mmHg.

After the evacuation, the cock 8 at the outlet was shut off and the cock 7 at the inlet was opened, whereupon ammonia was supplied into the gas reservoir 1 and used as a gas source.

Thereafter the cock 7 at the inlet was closed and the cock 8 at the outlet was opened whereupon ammonia was fed into the measuring system until the pressure therein reached a predetermined level, e.g. 50 Torr.

After the pressure in the measuring system was reduced due to the adsorption of ammonia by the pitch-based activated carbon fibers, the cock 8 at the outlet was opened to admit the ammonia into the measuring system until the pressure in the system returned to the predetermined level.

The foregoing operation was repeated. When the pressure in the measuring system became unvarying after a lapse of 30 minutes, it was taken as an equilibrium level and the resulting extension of the spring 6 was measured by a cathetometer wherein the reading was made in the order of 1/100 mm. The adsorption amount of ammonia was determined from the obtained value.

The adsorption amount of $N_2$ was measured by the following method.

Figure 9:
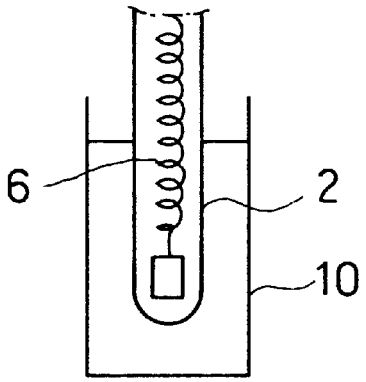
FIG. 9 is a fragmentary side view schematically showing in part the structure of a device for measuring the adsorption amount of $N_2$.

The same measuring device as used in measuring the adsorption amount of ammonia was employed. Nitrogen gas was fed into a gas reservoir 1 and used as a gas source. A specimen-holding tube 2 was immersed into a bath 10 of liquid nitrogen as shown in the fragmentary side view of FIG. 9. When the adsorption reached an equilibrium level, the resulting extension of quartz spring 6 was measured by a cathetometer wherein the reading was made in the order of 1/100 mm, whereby the adsorption amount of nitrogen was determined.

The adsorption amount of moisture was determined by the following method.

Figure 10:
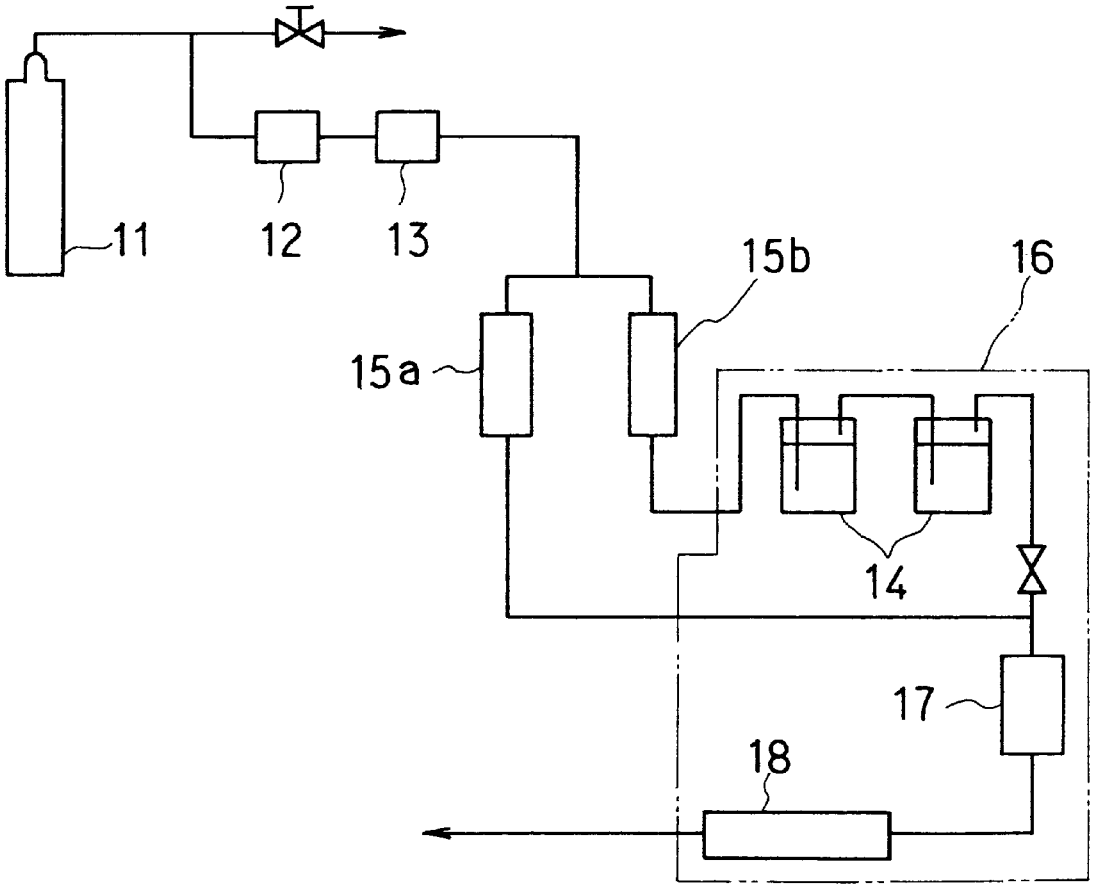
FIG. 10 is a view showing the structure of the device for measuring the adsorption amount of moisture.

As shown in the schematic view of FIG. 10, the air in an air cylinder 11 completely free of moisture was used as a specimen gas. The specimen gas was treated successively with calcium chloride 12 useful for moisture absorption and with activated carbon 13 useful for purification of air.

The treated specimen gas was separated into dried air and wetted air saturated with water vapor by the passage of gas through water tanks 14, 14. The specimen gas was supplied through flow meters 15*a*, 15*b* such that the dried air and the wetted air were fed at a predetermined flow ratio into a mixer 17 within a constant temperature chamber 16. After mixing, the gas adjusted to a predetermined temperature was supplied into an experimental column 18 until an adsorption equilibrium was reached in the column. After the equilibrium was reached, the activated carbon fibers were withdrawn from the column 18 and weighed to determine the adsorption amount of water. The column 18 accommodated about 1 g of dried activated carbon fibers before feeding of the gas.

What is claimed is:

1. In a gas phase adsorption process in which a gas phase containing water vapor or a basic gas is brought into contact with activated carbon fiber to adsorb the water vapor or basic gas, the improvement wherein the activated carbon fiber consists essentially of pitch-based oxidized activated carbon fiber, said pitch-based oxidized activated carbon fiber having been prepared by oxidizing pitch-based activated carbon fiber having a specific surface area of 200 to 2500 $m^2/g$, to provide the activated carbon fiber with oxygen-containing functional groups and an oxygen content of about 3 to about 18% by weight based on the weight of the fiber.

2. A method according to claim 1 wherein the basic gas is ammonia.

3. A method according to claim 2 wherein said pitch-based oxidized activated carbon fiber is capable of undergoing regeneration treatment in air at a temperature of about 500 to about 900° C.

4. A method according to claim 1 further comprising regenerating the activated carbon fiber by heating the activated carbon fiber in air at a temperature of about 500 to 900° C.

5. A method according to claim 4 wherein said basic gas is ammonia.

6. A process according to claim 2 wherein the oxygen content of the oxidized activated carbon fiber is about 6 to about 10% by weight.

7. A process according to claim 2 further comprising the steps of regenerating the activated carbon fiber, and re-using the regenerated activated carbon fiber in the gas phase adsorption process.

8. A process according to claim 7 wherein regeneration is effected by heating the activated carbon fiber in air at a temperature of about 500 to 900° C.

9. A process according to claim 2 wherein oxidation is effected by bringing pitch-based activated carbon fiber into contact with ozone, hydrogen peroxide, or nitric acid.

10. A process according to claim 2 wherein oxidation is effected by heating pitch-based activated carbon fiber at a temperature of about 300 to about 900° C. in an oxygen-containing atmosphere.

11. A process according to claim 10 wherein the oxygen-containing atmosphere comprises air.

12. A process according to claim 2 wherein the pitch-based activated carbon fiber as the starting material is prepared by subjecting coal tar to purification, distillation and polycondensation to obtain pitch, melt spinning the pitch, either infusibilizing the pitch fibers or infusibilizing and carbonizing the pitch fibers, and then activating the thus obtained carbon fibers.

13. A process according to claim 2 wherein the pitch-based activated carbon fibers as the starting material has a fiber diameter of about 12 $\mu$m, a tensile strength of about 8 to about 25 kg/mm$^2$, a tension modulus of about 330 to about 700 kg/mm$^2$, a specific surface area of about 200 to 2500 m$^2$/g and a pore radius of about 5 to 20 Å.

14. A process according to claim 2 wherein the oxidized pitch-based activated fiber is capable of adsorbing moisture to the extent of at least 120 mg/g at a relative humidity of 30%.

15. A process according to claim 2 wherein said oxidized pitch-based activated carbon fiber is capable of adsorbing moisture to the extent of at least 280 mg/g at a relative humidity of 50%.

* * * * *